United States Patent [19]

Loiacono et al.

[11] Patent Number: 4,822,728

[45] Date of Patent: Apr. 18, 1989

[54] SILVER HALIDE COLOR PHOTOGRAPHIC ELEMENTS

[75] Inventors: Marco Loiacono; Angelo Vallarino, both of Savona, Italy

[73] Assignee: Minnesota Mining and Manufacturing Company, St. Paul, Minn.

[21] Appl. No.: 131,586

[22] Filed: Dec. 11, 1987

[30] Foreign Application Priority Data

Dec. 18, 1986 [IT] Italy ..... 22741 A/86

[51] Int. Cl.[4] ..... G03C 1/08; G03C 7/32; G03C 5/24; G03C 1/46

[52] U.S. Cl. ..... 430/551; 430/381; 430/434; 430/444; 430/448; 430/502; 430/503; 430/505; 430/548; 430/627

[58] Field of Search ..... 430/551, 548, 502, 503, 430/505, 434, 444, 448, 387, 627

[56] References Cited

U.S. PATENT DOCUMENTS 3,547,899 12/1970 Arlt et al. ..... 526/234
3,926,436 12/1975 Monbaliu et al. ..... 430/544
4,199,363 4/1980 Chen ..... 430/556
4,420,556 12/1983 Booms et al. ..... 430/549
4,436,808 3/1984 Yasihara et al. ..... 430/548
4,578,346 3/1986 Watanabe et al. ..... 430/548

*Primary Examiner*—Mukund J. Shah
*Attorney, Agent, or Firm*—Donald M. Sell; Walter N. Kirn; Mark A. Litman

[57] ABSTRACT

A color image, wherein granularity is reduced under conditions allowing any sharpness loss to be kept under control, is obtained by image-wise exposing and developing in an alkaline water solution containing a color developer a silver halide color photographic element comprising a support base and at least a silver halide emulsion layer containing dispersed a non-diffusing hydrophobic coupler which upon reactiong with an oxidized developing agent forms a non-diffusing dye, characterized by the fact that said emulsion contains dispersed therein oil droplets, said droplets containing said non-diffusing coupler dissolved therein, and furthermore polymer particles in a quantity sufficient to obtain controlled smearing of the image-forming dye.

20 Claims, No Drawings

SILVER HALIDE COLOR PHOTOGRAPHIC ELEMENTS

FIELD OF THE INVENTION

The present invention relates to silver halide color photographic elements, in particular to such elements having improved granularity.

BACKGROUND OF THE INVENTION

It is well known that silver halide color photographic elements contain incorporated color couplers which after image-wise exposure react with oxidized aromatic primary amine color developing agents to form image dyes. The couplers and the image-forming dyes produced therefrom contain ballasting groups of such molecular size and configuration that they are rendered non-diffusing in the element as coated and during subsequent processing.

Ordinarily, for color reproduction the subtractive color process employes silver halide emulsions selectively sensitive to blue, green and red light which contain yellow, magenta and cyan color formers. Yellow, magenta and cyan color are respectively the complementary colors of blue, green and red. A coupler of the acylacetanilide type is generally used for forming a yellow color image while a coupler of the pyrazolone, pyrazolotriazole, pyrazolobenzimidazole, cyanoacetophenone or indazolone type is generally used for forming a magenta color image and a phenolic coupler, such as a phenol or naphthol, is generally used for forming a cyan color image.

The way with which such color couplers are introduced into the photographic layers is very important in the art. The so-called coupler dispersion technique (hereinafter better described) is the most conventional technique used in color photography. It is appreciated since beneficial effects are obtained on the stability of both couplers and dyes and colors are obtained which have the desired spectral absorption. Alternative techniques to introduce the color couplers into the photographic layers comprise the so-called loaded latex technique (hereinafter better described), which makes use of couplers loaded on polymer particles, and the polymer coupler technique as described in U.S. Pat. Nos. 3,370,952, 3,451,820, 3,707,412, 3,926,436, 4,080,211 and GB patent 1,247,688. Further techniques to reduce granularity associated with dye formation upon color development of a color forming coupler have been described in U.S. Pat. Nos. 4,420,556, 4,436,808 and 4,578,346. According to such techniques, non-polymeric or polymeric color couplers are used which form dyes of such mobility that an image smearing effect occurs in such element. The term "image dye smearing", as used in the art (see U.S. Pat. No. 4,420,556), means allowing the image dye produced upon color development to diffuse to a limited extent, so that neighboring clouds of image dye are smeared into each other leading to reduced image granularity. Since the reduction of granularity in a given layer, using such smearing coupler techniques, tends (by its own nature) to lead to a decrease of sharpness, various means have been described in the above patents to control image smearing.

Thus, according to U.S. Pat. No. 4,420,556, the coupler which provides image smearing is one which forms a dye which is slightly mobile so that the desired degree of image smearing has taken place by the time processing and drying is completed; or the coupler which provides image smearing is one which forms a dye which is diffusible and a mordant for the dye is associated with the layer containing that coupler; or the coupler which provides image smearing is associated with a coupler which forms non-diffusible dye, the greater the proportion of coupler which provides image smearing relative to the other coupler in the layer, the greater the amount of image smearing which occurs. According to U.S. Pat. No. 4,578,346, the coupler which provides image smearing is a dye diffusion type coupler dispersed in the layer after being dissolved in a high boiling point organic solvent (oil) and is associated with a polymer coupler latex contained in a layer adjacent to the layer containing said dye diffusion type coupler.

All of these techniques either use polymeric couplers in which the coupler is released upon development to form a diffusing dye or couplers which become diffusible upon color development, their diffusion inhibiting ballasting group being attached to the coupler itself in splittingoff position.

SUMMARY OF THE INVENTION

According to the present technique, conventional oil droplets, as used according to the coupler dispersion technique, comprising dissolved therein hydrophobic nondiffusible color couplers which form (upon color development) non-diffusible dyes, were reactively associated with polymer particles used with the loaded latex technique to obtain an image smearing effect. The couplers and the dispersed oil droplets, comprising them, are used in known way and quantity, while the quantity of the smearing polymer is dosed to obtain a controlled smearing effect, i.e. a granularity decrease with a controlled decrease in sharpness.

DETAILED DESCRIPTION OF THE INVENTION

The present invention refers to the obtaining of a smearing effect with conventional photographic non-diffusible color couplers which form (upon color development) non-diffusible dyes, that is couplers which have their diffusion inhibitig ballasting group or groups attached in a non-splitting-off position.

In one aspect the present invention relates to a color silver halide photographic element comprising a support base and at least one silver halide emulsion layer containing dispersed therein a hydrophobic non-diffusible coupler which, upon reaction with an oxidized color developing agent, forms a non-diffusible dye, characterized by the fact that said emulsion contains dispersed therein oil droplets, said droplets containing dissolved therein said non-diffusible coupler and said emulsion further containing polymer particles in a quantity sufficient to obtain a controlled smearing of the image-forming dye.

In a preferred aspect, the present invention relates to a silver halide color photographic element comprising a support base having coated thereon at least a red sensitive silver halide emulsion layer comprising a dispersed hydrophobic non-diffusible cyan color image forming coupler, at least a green sensitive silver halide emulsion layer comprising a dispersed hydrophobic non-diffusible magenta color image forming coupler and at least a blue sensitive silver halide emulsion layer comprising a dispersed hydrophobic non-diffusible yellow color image forming coupler, wherein at least one silver halide emulsion layer comprises oil droplets dispersed in said emulsion, said droplets containing dissolved therein a non-diffusible coupler which forms, upon color development, a nondiffusible dye and further polymer particles in a quantity sufficient to obtain a controlled smearing of the image dye.

In a further aspect the present invention relates to a method of forming a color image comprising (a) imagewise exposing a color silver halide photographic element comprising a support base and coated thereon at least a silver halide emulsion layer containing a dispersed hydrophobic non-diffusible coupler which, upon reaction with an oxidized color developing agent, forms a non-diffusible dye and (b) developing in an aqueous alkaline solution comprising an aromatic primary amine developing agent said exposed color silver halide photographic element, characterized by the fact that said developing is made in the presence of said coupler-containing hydrophobic oil droplets dispersed in said emulsion layer in reactive association with hydrophobic polymer particles in a quantity sufficient to obtain a controlled smearing of the image dye.

According to this invention hydrophobic non-diffusible color couplers capable of reacting with the color developer oxidation products to form non-diffusible dyes are dispersed in a silver halide emulsion layer of the photographic element, said layer further comprising dispersed therein hydrophobic oil droplets and hydrophobic polymer particles, such oil droplets having been introduced into the layer in the form of water-gelatin dispersion including said hydrophobic non-diffusible coupler solved in said oil droplets and such polymer particles having been introduced into the layer under the form of an aqueous polymer latex. The hydrophobic oil droplets and the hydrophobic polymer particles are separately introduced into the photographic layer. Even if they are supposed to be in reactive association one with the other to give the controlled smearing effect, the nature of such association is not fully understood.

Suitable couplers are preferably selected from the couplers having diffusion preventing groups, such as groups having a hydrophobic organic residue of about 8 to 32 carbon atoms, introduced into the coupler molecule in a non-splitting-off position. Such a residue is called "ballast group". The ballast group is bonded to the coupler nucleus directly or through an imino, ether, carbonamido, sulfonamido, ureido, ester, imido, carbamoyl, sulfamoyl bond, etc. Examples of suitable ballasting groups are described in U.S. Pat. No. 3,892,572.

In order to disperse the couplers into the silver halide emulsion layer, conventional coupler in oil dispersion methods well-known to the skilled in the art can be employed. Said methods, described for example in U.S. Pat. Nos. 2,322,027; 2,801,170; 2,801,171 and 2,991,177, consist of dissolving the coupler in a water-immiscible high boiling organic solvent (the "oil") and then mechanically dispersing such a solution in a hydrophilic colloidal binder under the form of small droplets having average sizes in the range from 0.1 to 1, preferably from 0.15 to 0.3 $\mu$. The preferred colloidal binder is gelatin, even if other kinds of binders can also be used.

Said non-diffusible couplers are introduced into the light-sensitive silver halide emulsion layers or into non-light-sensitive layers adjacent thereto. On exposure and color development, said couplers give a color which is complementary to the light color to which the silver halide emulsion layers are sensitive. Consequently, at least one non-diffusible cyan-image forming color coupler, generally a phenol or an $\alpha$-naphthol compound, is associated with red-sensitive silver halide emulsion layers, at least one non-diffusible magenta image-forming color coupler, generally a 5-pyrazolone or a pyrazolotriazole compound, is associated with green-sensitive silver halide emulsion layers and at least one non-diffusible yellow image forming color coupler, generally a acylacetanilide compound, is associated with blue-sensitive silver halide emulsion layers.

Said color couplers may be both 4-equivalent and 2-equivalent couplers, the latter requiring a smaller amount of silver halide for color production. As known, 2-equivalent couplers derive from 4-equivalent couplers since, in the coupling position, they contain a substituent which is released during coupling reaction. 2-Equivalent couplers which may be used in the present invention include both those substantially colorless and those which are colored ("masked couplers"). The 2-equivalent couplers also include the known white couplers which do not form any dye on reaction with the color developer oxidation products. The 2-equivalent color couplers include also the known DIR couplers which are capable of releasing a diffusing development inhibiting compound on reaction with the color developer oxidation products.

Examples of cyan couplers which can be used in the present invention can be selected from those described in U.S. Pat. Nos. 2,369,929; 2,474,293; 3,591,383; 2,895,826; 3,458,315; 3,311,476; 3,419,390; 3,476,563 and 3,253,924; and in British Pat. No. 1,201,110.

Examples of magenta couplers which can be used in the present invention can be selected from those described in U.S. Pat. Nos. 2,600,788; 3,558,319; 3,468,666; 3,419,301; 3,311,476; 3,253,924 and 3,311,476 and in British Pat. Nos. 1,293,640; 1,438,459 and 1,464,361.

Examples of yellow couplers which can be used in the present invention can be selected form those described in U.S. Pat. Nos. 3,265,506, 3,278,658, 3,369,859, 3,528,322, 3,408,194, 3,415,652 and 3,235,924, in German patent applications Nos. 1,956,281, 2,162,899 and 2,213,461 and in British Pat. Nos. 1,286,411, 1,040,710, 1,302,398, 1,204,680 and 1,421,123.

Colored cyan couplers which can be used in the present invention can be selected from those described in U.S. Pat. Nos. 3,934,802; 3,386,301 and 2,434,272.

Colored magenta couplers which can be used in the present invention can be selected from the colored magenta couplers described in U.S. Pat. Nos. 2,434,272; 3,476,564 and 3,476,560 and in British Pat. No. 1,464,361.

Colorless couplers which can be used in the present invention can be selected from those described in British Pat. Nos. 861,138; 914,145 and 1,109,963 and in U.S. Pat. No. 3,580,722.

Examples of DIR couplers or DIR coupling compounds which can be used in the present invention include those described in U.S. Pat. Nos. 3,148,062; 3,227,554; 3,617,291; in German patent applications S.N. Nos. 2,414,006; 2,659,417; 2,527,652; 2,703,145 and 2,626,315; in Japanese patent applications S.N. Nos. 30,591/75 and 82,423/77 and in British Pat. No. 1,153,587.

Examples of non-color forming DIR coupling compounds which can be used in the present invention include those described in U.S. Pat. Nos. 3,938,996; 3,632,345; 3,639,417; 3,297,445 and 3,928,041; in German patent applications S.N. Nos. 2,405,442; 2,523,705; 2,460,202; 2,529,350 and 2,448,063; in Japanese patent applications S.N. Nos. 143,538/75 and 147,716/75 and in British Pat. Nos. 1,423,588 and 1,542,705.

With the present invention hydrophobic polymer particles incorporated in the light sensitive element are believed to cause neighboring clouds of image dye to be smeared into each other thus reducing granularity. With multilayer color photographic elements the reduction in granularity may be effected in any of the dye image forming layers. When the dye image forming layer is comprised of more than one layer sensitive to a region of the visible spectrum, the reduction in granularity may be effected in each or in only one of the layers, preferably in the lower sensitivity emulsion layer. Similarly, the reduction in granularity may be effected in all layers sensitive to the primary (blue, green and red ) regions of the visible spectrum or in only one or two of such layers, preferably the red sensitive emulsion layer.

Since the reduction in granularity in a given layer of the light sensitive element may lead to decrease of sharpness of the image formed, it is desired to control the image smearing according to the present invention such that the granularity in the layer or layers is reduced only to an extent that sharpness is not significantly reduced. The skilled in the art can adjust the amount of hydrophobic polymer in the layer where granularity is to be reduced with no reduction of sharpness to values lower than the desired pre-determined values. According to the experiments made by the Applicant, when conventional amounts of color couplers are used to obtain, as known in the art, the desired image dye formation (in the presence of conventional amounts of oil to disperse the couplers at conventional gelatin/coupler ratios), amounts of 10 to less than 40 percent by weight of hydrophobic polymer to the hydrophilic colloid (gelatin) of the layer, preferably amounts of 20 to 30 percent, are useful to significantly reduce granularity though sharpness is maintained at an acceptable high level. Normally, higher amounts of hydrophobic polymer, while reducing still more granularity, make the sharpness decrease to a level too low to be accepted. By its own nature, the present invention provides for a "controlled" smearing effect because the quantity of the polymer particles can easily be chosen and corrected (during the manufacturing process) to obtain a desired smearing effect with no loss of sharpness (in the final image, including the image which is enlarged into a screen, as for example with color reversal images) higher than acceptable (for example not higher than the one which can be perceived by human eye).

The hydrophobic polymer particles according to the present invention constitute the dispersed phase of an aqueous polymer latex. Typically, the hydrophobic polymers which are most useful to the purposes of the present invention are those which can be used in photography according to the polymer latex loading techniques as described in British Patent Applications S.N. Nos. 2,003,486; 2,016,017 and 2,072,365; in U.S. Pat. No. 4,199,363 in GB Pat. No. 1,504,950 and in EP Patent Application S.N. No. 14,921. The hydrophobic polymer particles, useful in the present invention, can be chosen from among those which meet the following Compatible and Smearing Polymer Particle Test.

Compatible and Smearing Polymer Particle Test i. One polymer is photographically compatible when (a) is capable of forming a latex with water at 25° C. at a polymer particle concentration of from 10 to 20% by weight, based on total weight of the latex, (b) the obtained aqueous polymer latex, when incorporated into a 10% gelatin water solution at 36° C., does not show any visible aggregation or precipitation of the polymer particles, (c) 100 ml of the latex, mixed with an equal volume of a water-miscible organic solvent, stirred and allowed to stand for 10 minutes at 25° C., exibit no observable coagulation of the polymer particles.

ii. One polymer is photographically effective as a smearing polymer particle when a light sensitive gelatin silver halide color photographic element, including a non-diffusible color coupler solved in oil droplets and an aqueous latex of said polymer dispersed therein, upon conventional exposure and color development, forms a color image having a lower granularity (conventionally measured as RMS granularity) with respect to the image obtained with the same photographic element not including dispersed therein said aqueous latex of said polymer (this is called the reference photographic element). Preferably, RMS granularity values at a density equal to 1 obtained with the elements of the present invention with respect to those obtained with the reference photographic element should be lower at least of 10%, more preferably of at least 15%. The RMS (Roote Mean Square) granularity method and apparatus to evaluate the granularity are well known in the art (see for example "The Theory of the Photographic Process", 4th Edition, T.H. James, page 616 and "RMS granularity: Determination of Just Noticeable Difference", Photographic Science and Engineering, Vol. 19, No. 4, 1975, pages 235–238). The water-miscible organic solvents to be used in the above test are those which can be dissolved in water for at least 20 parts by volume of solvent in 80 parts by volume of water at 20° C. and do not dissolve more than about 5 weight percent of such smearing polymer particles at 20° C. Typical non limiting examples of such watermiscible organic solvents are acetone, ethyl alcohol, methyl alcohol, and isopropyl alcohol, dimethylformamide, methyl ethyl ketone, tetrahydrofuran, N-methyl-2-pyrrolidone, dimethylsulfoxide and mixtures thereof.

The hydrophobic polymers useful in the practice of this invention can be formed by a variety of different polymers. Hydrophobic polymers which are particularly useful are polymers made from emulsion copolymerizable ethylenically unsaturated monomers and which contain at least one compound having a hydrophilic group such as sulfo, sulfonate, sulfonyl, carboxy, carboxylate, hydroxy, amido, sulfonamido, quaternary ammonium, polyalkyleneoxide and sulfate as described in British Patent Applications Nos. 2,003,486 and 2,016,017. A preferred class of hydrophobic polymers comprises polymers made from at least two emulsion copolymerizable ethylenically unsaturated monomers, wherein from 2 to 25 percent by weight comprise a monomer containing a carboxylic acid or carboxylate or preferably a sulfonic acid or sulfonate group as described in U.S. Pat. No. 4,199,363 and in GB Pat. No. 1,504,950. Another preferred class of hydrophobic polymers comprises polymers made by copolymerizing a copolymerizable non-ionic hydrophobic monomer and at least one acrylic or methacrylic acid ester or amide monomer containing an alkyleneoxide chain as described in British Patent Application S.N. No. 2,072,365.

A more preferred class of hydrophobic polymers according to the present invention comprises polymers consisting, for at least 70% of its weight, of:

(a) repeating units derived from an ethylenic monomer containing a sulfonic or sulfonate group, said monomer being capable of forming hydrophilic homopolymers, said units comprising from 0.5 to 1.5% by weight of the hydrophobic polymer, (b) repeating units derived from an N-3-oxo-alkyl-substituted acrylamide, said units comprising from 5 to 25% by weight of the hydrophobic polymer, (c) repeating units derived from acrylic acid ester monomers having a TG lower than 0° C., said units comprising at least 43.5% of the hydrophobic polymer, the remaining polymer weight percentage, from zero up to 30%, being forming by repeating units derived from photographically inert monomers and/or cross-linking monomers.

Preferably, the above described hydrophobic polymer comprises at least 80% by weight of said units (a), (b) and (c) wherein units (c), derived from acrylic acid ester monomers, are present in a quantity of at least 53.5% by weight. More preferably the above described hydrophobic polymer comprises at least 90% by weight of said units (a), (b) and (c), wherein units (c), derived from acrylic acid ester monomers, are present in a quantity of at least 63.5% by weight. Of course, in both preferred and more preferred cases above, the remaining polymer percentage formed by inert and/or cross-linking monomers may be of any value, starting from zero, up to 20 or 10, respectively.

In a specific preferred form, the ethylenic monomers capable of forming hydrophilic homopolymers, from which said repeating units (a) derive, are those corresponding to the following formula:

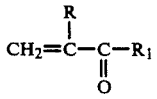

wherein R represents hydrogen or a low alkyl group having from 1 to 4 carbon atoms, $R_1$ represents an organic divalent radical which, together with the carbonyl group of the formula, forms an ester or amido linking group ending with a solubilizing group $SO_3M$, wherein M is hydrogen, ammonium or alkali metal. Specifical examples of ethylenic hydrophilic monomers useful to the present invention comprise the following compounds:

3-Acryloyloxypropane-1-sulfonic acid;
3-Methacryloyloxypropane-1-sulfonic acid;
2-Acrylamido-2-methylpropane-sulfonic acid;
3-Methacryloyloxypropane-1-methyl-1-sulfonic acid;
Acryloylmethane-sulfonic acid;
4-Acryloyloxybutane-1-sulfonic acid;
2-Acryloyloxyethane-1-sulfonic acid;
2-Acrylamidopropane-1-sulfonic acid;
2-Methacrylamido-2-methylpropane-1-sulfonic acid;
3-Acrylamido-3-methylbutane-1-sulfonic acid,
and the alkali metal salts thereof, preferably Na or K, or ammonium salts.

The N-3-oxo-alkyl-substituted acrylamide monomers, from which derive the repeating units (b) partially forming the polymer of the present invention, preferably correspond to the formula:

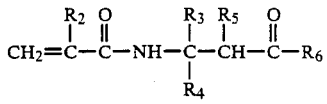

wherein $R_2$ represents hydrogen or a low alkyl group having from 1 to 4 carbon atoms and $R_3$, $R_4$, and $R_5$ and $R_6$ each represents hydrogen, a low alkyl group with from 1 to 4 carbon atoms or a cycloalkyl group having a maximum of 10 carbon atoms. Specifical examples of N-3-oxo-alkyl-substituted acrylamides include:

N-3-oxopropyl-acrylamide;
N-3-oxobutyl-acrylamide;
N-3-oxo-1-methyl-butyl-acrylamide;
N-3-oxo-1-methyl-1,3-diethyl-acrylamide;
N-3-oxo-1,1-dimethyl-butyl-acrylamide (diacetone-acrylamide);
N-3-oxo-methyl-1,3-dicyclohexyl-propyl-acrylamide;
N-3-oxo-1,5-dimethyl-1-isopropyl-hexyl-acrylamide;
N-3-oxo-1,1-diisobutyl-2-isopropyl-5-methylhexyla-crylamide;
N-3-oxo-1,1-dibutyl-2-n-propylheptyl-acrylamide;
N-3-oxo-1-methyl-butyl-α-methylacrylamide;
N-3-oxo-1,1-dimethylbutyl-α-methylacrylamide, and the like.

The acrylic acid ester monomers, from which derive the repeating units (c) partially forming the polymer of the present invention, are preferably described as acrylic acid esters having the formula:

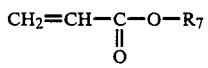

wherein $R_7$ is an alkyl or alkoxyalkyl group having from 2 to 20 carbon atoms. Said acrylate esters have a TG lower than 0° C., this meaning that the polymers derived from said monomers have a glass transition temperature (TG), corresponding to the well-known change of a hard and brittle polymer into a soft polymer, lower than 0° C. Specifical examples of acrylate ester monomers according to the present invention include the following compounds: sec.butylacrylate; n-butylacrylate; isobutylacrylate; 2-ethylhexyacrylate; ethylacrylate; ethoxyethylacrylate; hexylacrylate; isopropylacrylate; pentylacrylate; octylacrylate; tetradecylacrylate.

To the purposes of the present invention, the presence of both said repeating units (a), derived from ethylenic monomers containing a sulfonic or sulfonate group, and said repeating units (b), derived from N-3-oxo-alkyl-substituted acrylamide monomers, in combination with the repeating units (c), derived from acrylic ester monomers, proved to be essential to form the polymer of the present invention (or a substantial part thereof).

Of course, the man skilled in the art can choose within the indicated intervals the quantities which best suit his specifical needs. Too low quantities of repeating units (a) derived from ethylenic monomers containing a sulfonic or sulfonate group and/or repeating units (b) derived from N-3-oxo-alkyl-substituted acrylamide monomers cause problems of incompatibility of the latex with the hydrophilic colloid, generally gelatin, forming the photographic layer, while excessive quantities thereof may lead to high-viscosity latexes with problems of polymer separation or larger sizes of the dispersed polymer particles. Said inert or cross-linking repeating units are not essential or necessary to the purposes of the present invention. If they are present, for reasons of preparation or use, they are to be chosen so as not to negatively affect the stability, loadability and compatibility characteristics of the latexes of the present invention.

Examples of inert monomers are the ethylenic monomers (such as isoprene, 1,3-butadiene, propenenitrile, vinyl chloride, ethylene, propylene and the like), the styrene type monomers (such as styrene, vinyltoluene, chloromethylstyrene, α-methyl-styrene, 2-ethylstyrene, 1-vinylnaphthalene and the like), the 2-alkenoic acid esters (such as methyl, ethyl, propyl, butyl, hexyl, dodecyl, hexadecyl esters of methacrylic, α-ethylacrylic, α-propylacylic, 2-butenoic, 2-hexenoic, 2-methyl-2-octenoic acids and the like), the acrylamide monomers (such as acrylamide, N-methylacrylamide, N,N-dimethylacrylamide, N-butylacrylamide, N-chloromethylacrylamide, N-bromomethyl-acrylamide and the like) and vinyl acetate.

In particular, repeating units derived from crosslinking monomers can prove to be useful if incorporated into the hydrophobic polymers of the present invention in order to improve the stability of the latex if stored for long time, to increase its hydrophobicity, to reduce its tendency to swell at high temperatures or in the presence of water-miscible organic solvents, to reduce the tendency of the polymeric particles to agglomerate or coagulate, to improve the abrasion resistance of the polymer particles.

A specifical class of monomers capable of forming cross-linking repeating units, to the purposes of the present invention, is represented by monomers containing two vinyl groups, preferably corresponding to the following formula:

$$CH_2{=}CH{-}R_8{-}CH{=}CH_2$$

wherein $R_8$ is a divalent organic group. The divalent group represented with $R_8$, as known in the art of the photographic hardeners, includes any divalent group of reasonable size and nature such as not to negatively affect the properties of the photographic material, preferably an aromatic or saturated cyclic hydrocarbon group having from 6 to 12 carbon atoms, such as a substituted or not substituted phenylene or cyclohexylene, or an acyclic hydrocarbon group such as an alkylene having from 1 to 8 carbon atoms, such as methylene, ethylene, trimethylene, etc. The divalent group represented by $R_8$ can also be an aralkylene (including for instance a phenylene and one or two alkylene groups attached thereto) having a total from 7 to 12 carbon atoms. At least one of the carbon atoms of the group defined above with $R_8$ can be substituted with a hetero-atom, such as nitrogen, sulfur, oxygen and/or with an organic group, such as sulfonyl, ureilene, iminocarbonyl, etc. Suitable examples of divalent organic groups include: $-SO_2-CH_2-CH_2-O-CH_2-CH_2-SO_2-$, $-SO_2-CH_2-CHOH-CH_2-SO_2-$, $-CO-NH-CO-$, $-CO-NH-CH_2-NH-CO-$, $-SO_2-CH_2-CH_2-SO_2-$and

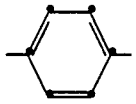

The hydrophobic polymer latexes of the present invention essentially consist of water as a continuous phase and of hydrophobic polymer particles as a dispersed phase. Said particles are typically finer as compared with the oil dispersions and similar dispersions of hydrophobic particles in hydrophilic colloid coatings. The average size of the hydrophobic polymer particles is comprised in the range from 0.02 to 0.2 μ, preferably from about 0.02 to about 0.08 μ. The hydrophobic polymer particles form at least 5% by weight of the aqueous latex, preferably at least 10% and more preferably about 20%.

The hydrophobic polymer latexes according to the present invention can be synthesized according to methods well-known to the man skilled in the art. They can be formed for instance by using the conventional free radical emulsion polymerization method to form organic polymeric hydrosols. Typically, the aqueous latex with the polymeric particles distributed therein can be formed by adding in water the various monomers necessary to form the desired hydrophobic polymer together with minor quantities of ingredients, such as emulsifying agents, polymerization initiators, polymerization control agents, etc., and heating the resulting mixture at a temperature ranging for instance from 40° to 90° C. under stirring for several hours. The proportions with which the monomers are loaded approximately determine the proportions of the repeating units in the hydrophobic polymer. More exactly, the proportions of the repeating units in the hydrophobic polymers can be obtained under consideration of the known differences in the monomer polymerization rates. Since the differences introduced by such variations are not significant, said proportions are considered the proportions of the monomers introduced for the polymerization. Useful free radical polymerization techniques which can be used to prepare the hydrophobic polymer latexes of the present invention are described in U.S. Pat. Nos. 2,914,499; 3,033,833; 3,547,899 and in Canadian Pat. No. 704,778.

A further class of hydrophobic polymers forming the dispersed particle phase of an aqueous polymer latex useful in the present invention comprises polyurethane polymers as described in U.S. Pat. Nos. 2,968,575, 3,213,049, 3,294,724, 3,565,844, 3,388,087, 3,479,310 and 3,873,484 and in European Patent Application S.N. No. 14,921. Generally, polyurethane polymers are derived from diisocyanate components and an organic compound having two active hydrogen atoms and polyurethane latices are prepared by chain-extending a prepolymer which is the reaction product of the diisocyanate and the organic compound having the two hydrogen atoms. Useful types of organic compounds which have useful hydrogen atoms include polyalkylene ether glycols, alkyd resins, polyesters and polyester amides. Polyurethane latices are generally prepared by emulsifying the prepolymer and then chain-extending the prepolumer in the presence of water.

The photographic elements of the present invention are preferably multilayer color elements comprising a blue sensitive or sensitized silver halide emulsion layer associated with yellow dye-forming color couplers, a green sensitized silver halide emulsion layer associated with magenta dye-forming color couplers and a red sensitized silver halide emulsion layer associated with cyan dyeforming color couplers. Each layer can be comprised of a single emulsion layer or of multiple emulsion sub-layers sensitive to a given region of visible spectrum. When multilayer materials contain multiple blue, green or red sub-layers, there can be in any case relatively faster and relatively slower sub-layers.

The silver halide emulsion used in this invention may be a fine dispersion of silver chloride, silver bromide, silver chloro-bromide, silver iodo-bromide and silver chloro-iodo-bromide in a hydrophilic binder. As hydrophilic binder, any hydrophilic polymer of those conventionally used in photography can be advantageously employed including gelatin, a gelatin derivative such as acylated gelatin, graft gelatin, etc., albumin, gum arabic, agar agar, a cellulose derivative, such as hydroxyethylcellulose, carboxymethyl-cellulose, etc., a synthetic resin, such as polyvinyl alcohol, polyvinylpyrrolidone, polyacrylamide, etc. Preferred silver halides are silver iodo-bromide or silver iodo-bromo-chloride containing 1 to 12% mole silver iodide. The silver halide grains may have any crystal form such as cubical, octahedral, tabular or a mixed crystal form. The silver halide can have a uniform grain size or a broad grain size distribution. The size of the silver halide ranges from about 0.1 to about 5 $\mu$. The silver halide emulsion can be prepared using a single-jet method, a double-jet method, or a combination of these methods or can be matured using, for instance, an ammonia method, a neutralization method, an acid method, etc. The emulsions which can be used in the present invention can be chemically and optically sensitized as described in Research Disclosure 17643, III and IV, December 1978; they can contain optical brighteners, antifogging agents and stabilizers, filtering and antihalo dyes, hardeners, coating aids, plasticizers and lubricants and other auxiliary substances, as for instance described in Research Disclosure 17643, V, VI, VIII, X, XI and XII, December 1978. The layers of the photographic emulsion and the layers of the photographic element con contain various colloids, alone or in combination, such as binding materials, as for instance described in Research Disclosure 17643, IX, December 1978. The above described emulsions can be coated onto several support bases (cellulose triacetate, paper, resin-coated paper, polyester included) by adopting various methods, as described in Research Disclosure 17643, XV and XVII, December 1978. The light-sensitive silver halide contained in the photographic elements of the present invention after exposure can be processed to form a visible image by associating the silver halide with an aqueous alkaline medium in the presence of a developing agent contained in the medium or in the element. Processing formulations and techniques are described in Research Disclosure 17643, XIX, XX and XXI, December 1978.

The following examples are described for a better understanding of this invention.

PREPARATIVE EXAMPLE 1

Preparation of latex SL-1

Poly-(n-butylacrylate-co-diacetoneacrylamideco-2-methacryloyloxyethane-1-sulfonic acid sodium salt) (89/10/1)

A solution of 0.5 g of sodium laurylsulfate in 400 ml of water was heated at 90° C. under stirring. This solution was then added with 0.5 g of ammonium persulfate. The resulting solution, kept under continuous stirring, was then simultaneous added with a mixture of 89 g of n-butylacrylate and 10 g of diacetoneacrylamide and a solution of 2-methacryloyl-oxyethane-1-sulfonic acid sodium salt in 30 ml of water. The resulting solution was kept under continuous stirring for 3 hours at 95° C. The unreacted monomers were eveporated at 80° C. for 5 hours and the resulting latex was cooled at room temperature thus obtaining 515 ml of a latex having 19% of dispersed polymer.

PREPARATIVE EXAMPLE 2

Preparation of latex SL-2

Poly-[n-butylacrylate-co-diacetoneacrylamide-co2-methacryloyloxyethane-1-sulfonic acid sodium salt-co-1,3-bis(vinylsulfonyl)-2-propanol](87/10/1/2)

Latex SL-2 was prepared as described in Preparative Example 1 using 87 g of butylacrylate, 10 g of diacetoneacrylamide, 1 g of 2-methacryloyloxyethane-1-sulfonic acid sodium salt and 2 g of 1,3-bis-(vinylsulfonyl)-2-propanol thus obtaining a latex with 20% of dispersed polymer. Once isolated from the dispersion, the copolymer resulted insoluble in common organic solvents.

EXAMPLE 1

A multilayer light sensitive color reversal element (Film A; comparative example) composed of layers having the following composition coated on a cellulose triacetate film support was prepared.

The 1st layer: Antihalation layer. A gelatin layer containing black colloidal silver at a silver coating weight of 0.2 g/m$^2$.

The 2nd layer: Red sensitive low speed emulsion layer. A gelatin layer comprising a silver bromo-iodide emulsion (silver iodide: 7% by mol; average grain size: 0.65 $\mu$) at a silver coating weight of 0.62 g/m$^2$ and a silver/gelatin ratio of 0.30, Sensitizing dye I in amount of 0.000135 mol per mol of silver, Sensitizing dye II in amount of 0.000316 mol per mol of silver, Coupler A in an amount of 0.211 mol per mol of silver dispersed in tricresylphosphate and diethyllauramide.

The 3rd layer: Red sensitive high speed emulsion layer. A gelatin layer comprising a silver bromo-iodide emulsion (silver iodide: 7% by mol; average grain size: 1.18 $\mu$) at a silver coating weight of 0.57g/m$^2$ and a silver/gelatin ratio of 0.30, Sensitizing dye I in amount of 0.000123 mol per mol of silver, Sensitizing dye II in an amount of 0.000293 mol per mol of silver, Coupler A in an amount of 0.221 mol per mol of silver dispersed in tricresylphosphate and diethyllauramide.

The 4th layer: Intermediate layer. A gelatin layer comprising 2,5-ditert.-octylhydroquinone dispersed in tricresylphosphate.

The 5th layer: Green sensitive high speed emulsion layer. A gelatin layer comprising a silver bromo-iodide emulsion (silver iodide: 7% of mol; average grain size: 1.18 $\mu$) at a silver coating weight of 0.63 g/m$^2$ and a silver/gelatin ratio of 0.46, Sensitizing dye III in an amount of 0.000866 mol per mol of silver Sensitizing dye IV in an amount of 0.000190 mol per mol of silver, Coupler B in an amount of 0.183 mol per mol of silver.

The 6th layer: Green sensitive low speed emulsion layer. A gelatin layer comprising a blend of a silver bromo-iodide emulsion (silver iodide: 7% by mol; average grain size:0.65 μ) and a silver bromo-iodide emulsion (silver iodide: 5% by mol; average grain size: 0.29 μ) at a total silver coating weight of 0.46 g/m$^2$ and a total silver/gelatin ratio of 0.41, Sensitizing dye III in an amount of 0.000935 mol per mol of silver, Sensitizing dye IV in an amount of 0.00021 mol per mol of silver and Coupler B in an amount of 0.132 mol per mol of silver.

The 7th layer: Intermediate layer. The same as the 4th layer.

The 8th layer: Yellow filter layer. A gelatin layer comprising dispersed yellow colloidal silver.

The 9th layer: Blue sensitive high speed emulsion layer. A gelatin layer comprising a blend of a silver bromo-iodide emulsion (silver iodide: 7% by mol; average grain size: 1.18 μ) and a silver bromo-iodide emulsion (silver iodide: 14% by mol; average grain size: 1.4 μ) at a total silver coating weight of 0.85 g/m$^2$ and a total silver/gelatin ratio of 0.52, Sensitizing dye V in an amount of 0.00015 mol per mol of silver, Coupler C in an amount of 0.145 mol per mol of silver and Coupler D in an amount of 0.071 mol per mol of silver both dispersed in tricresylphosphate and diethylalauramide.

The 10th layer: Blue sensitive low speed emulsion layer. A gelatin layer comprising a silver bromo-iodide emulsion (silver iodide: 7% by mol; average grain size: 0.65 μ) at a silver coating weight of 0.55 g/m$^2$ and a silver/gelatin ratio of 0.46, Sensitizing dye V in an amount of 0.000133 mol per mol of silver, Coupler C in an amount of 0.147 mol per mol of silver and Coupler D in an amount of 0.071 mol per mol of silver both dispersed in tricresylphosphate and diethyllauramide.

The 11th layer: Protective layer. A gelatin layer comprising polymethylmethacrylate particles of mean diameter 2 μ and 2-(2'-hydroxy-3',5'-di-t-butylphenyl)-5-t-butyl-benzotriazole UV absorber dispersed in tricresylphosphate and dibutylphthalate.

Gelatin hardeners, surface active agents, antifogging and stabilizing agents were in addition added to the layers.

A second multilayer light sensitive color reversal element (Film B: example according to this invention) was prepared by following the same procedure as in Film A, except that the 2nd red sensitive low speed layer comprised latex SL-2 in an amount corresponding to 0.71 g/m$^2$ of polymer and was coated at a silver/gelatin ratio of 0.60.

Samples of the two elements were given identical sensitometric stepped exposures and processed together through the reversal color process E6 described in "Using Process E6, Kodak Publication N2-119". Sensitometric characteristics and granularity of cyan images are reported in Table 1. The granularity was evaluated by the conventional RMS (Roote Mean Square) granularity method as described in "The Theory of the Photographic Process", 4th Edition, T.H. James, p. 616, using a scanning aperture of 48 μ.

TABLE 1

| Film | D Max | Speed | Contrast | RMS granularity |
|---|---|---|---|---|
| A (Compar. ex.) | 2.70 | 27.3* | 1.67 | 36.5** |
| B (Pres. invent.) | 2.79 | 27.2* | 1.88 | 22.5** |

*Speed expressed in DIN measured at Density 1.

**Granularity measured at Density 1.

Compounds used for preparing films A and B are the following.

Sensitizing Dye I:

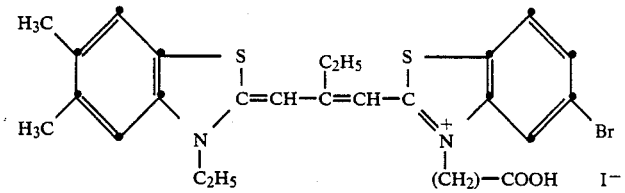

Sensitizing Dye II:

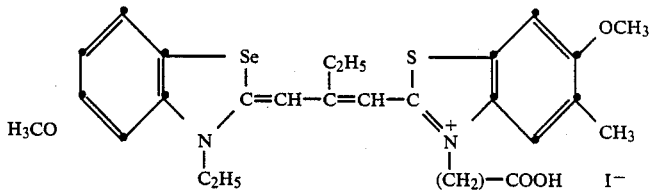

Coupler A:

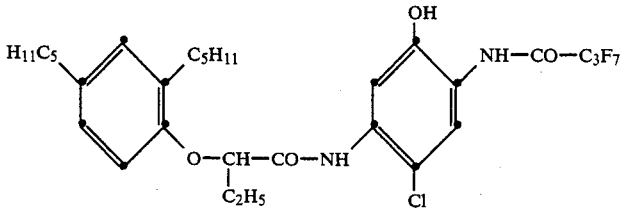

Sensitizing Dye III:

TABLE 1-continued
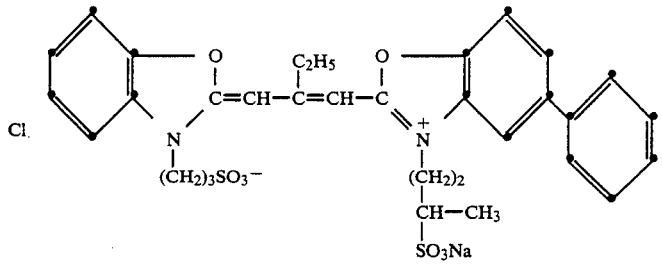
Sensitizing Dye IV:
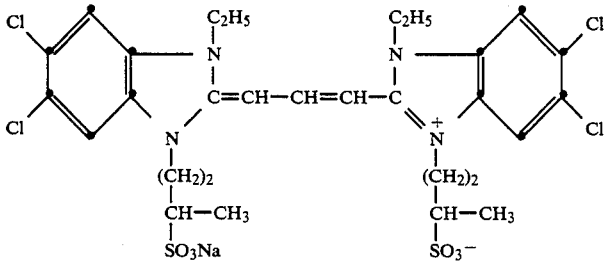
Coupler B:
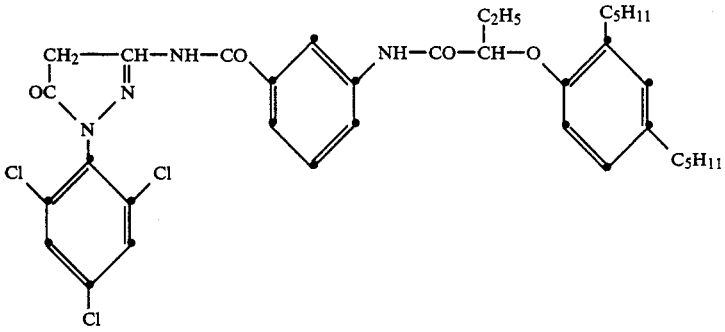
Sensitizing Dye V:
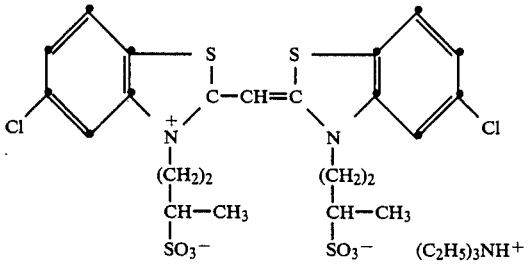
Coupler C:
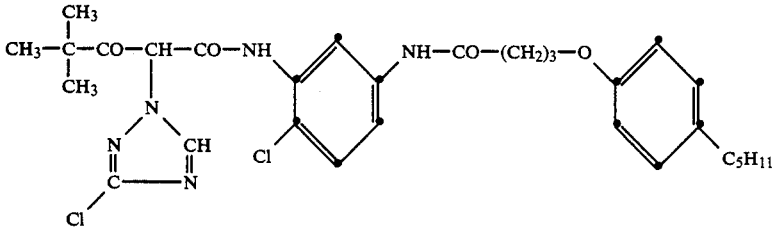
Coupler D:

TABLE 1-continued

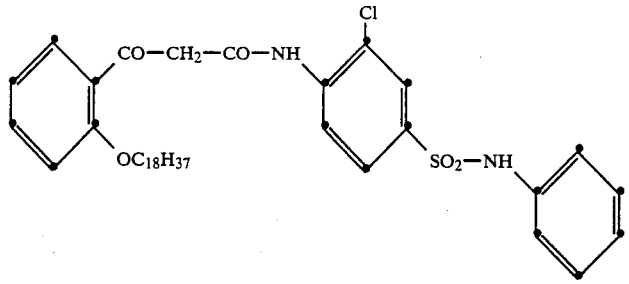

EXAMPLE 2

A single light sensitive layer color reversal element (Film C: comparative example) was prepared by coating on a cellulose triacetate film support the 1st antihalation layer and the 2nd red sensitive low speed emulsion layer of Film A described in Example 1.

Eight different single light sensitive layer color reversal elements (Films D to M of this invention) were prepared by the same manner as in Film C, except that the red sensitive low speed layers each comprised different polymeric latexes.

The following Table 2 reports the type and amount of polymeric latex, the RMS values as well as sharpness evaluation made by a skilled person.

TABLE 2

| Film | Latex | Amount (*) | RMS granularity D = 1.0 | D = 0.5 | D = 0.3 | Sharpness |
|---|---|---|---|---|---|---|
| C | — | — | 39 | 28 | 20 | good |
| D | SL-1 | 21 | 32 | 21 | 15 | good |
| E | SL-2 | 21 | 34 | 23 | 17 | good |
| F | SL-3 | 21 | 33 | 22 | 16 | good |
| G | SL-4 | 21 | 31 | 24 | 16 | good |
| H | SL-1 | 40 | 28 | 19 | 15 | bad |
| I | SL-2 | 40 | 28 | 19 | 15 | bad |
| L | SL-3 | 40 | 31 | 21 | 15 | bad |
| M(**) | SL-4 | 40 | — | — | — | bad |

(*) grams o polymer per 100 grams of gelatin
(**) reticulated sample.

We claim:

1. A color silver halide photographic element comprising a support base and at least one silver halide emulsion layer containing dispersed therein a hydrophobic non-diffusible coupler which, upon reaction with an oxidized color developing agent, forms a non-diffusible image dye, characterized by the fact that said emulsion contains dispersed therein droplets of a high temperature boiling point organic solvent, said droplets containing dissolved therein said non-diffusible coupler, and said emulsion further contains a polymer particles in a sufficient quantity to obtain controlled smearing of the image dye.

2. The photographic element of claim 1 wherein the hydrophobic polymer is selected within the class consisting of a sulfonic or sulfonate group containing vinyl addition polymer and a polyurethane polymer.

3. The photographic element of claim 1 wherein the hydrophobic polymer for at least 70% of its weight comprises:

(a) repeating units derived form an ethylenic monomer containing a sulfonic or sulfonate group which monomer is capable of forming hydrophilic homopolymers, said units comprising from 0.5 to 1.5% by weight by the hydrophobic polymer, (b) repeating units derived from a N-3-oxo-alkyl substituted acrylamide, said units comprising from 5 to 25% by weight of the hydrophobic polymer, and (c) repeating units derived from acrylic acid ester monomers having a TG lower than 0° C., said units comprising at least 43.5% by weight of the hydrophobic polymer, the remaining polymer weight percentage, from zero to 30%, being formed by repeating units derived from inert monomers and/or cross-linking monomers.

4. The photographic element of claim 3 wherein the monomer capable of forming hydrophilic homopolymers has the formula:

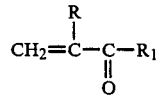

wherein R represents a hydrogen or a low alkyl group having from 1 to 4 carbon atoms, $R_1$ is a divalent organic radical which, together with the carbonyl group of the formula, forms an ester or amido linking group ending in a $SO_3M$ solubilizing group, where M is hydrogen, ammonium or an alkali metal.

5. The photographic element of claim 3 wherein the N-3-oxo-alkyl substituted acrylamide monomer has the formula:

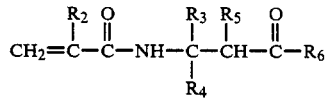

wherein $R_2$ represents hydrogen or a low alkyl group having from 1 to 4 carbon atoms, $R_3$, $R_4$, $R_5$ and $R_6$ each represents hydrogen, a low alkyl group with 1 to 4 carbon atoms or a cycloalkyl group having a maximum of 10 carbon atoms.

6. The photographic element of claim 3 wherein the acrylic ester monomer has the formula:

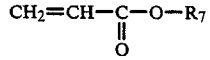

wherein $R_7$ is an alkyl or alkoxyalkyl group having from 2 to 20 carbon atoms.

7. The photographic element of claim 4 wherein the ethylenic monomer capable of forming hydrophilic polymers is the acryloyoxyethanesulfonic acid sodium salt, the acrylamidoethansulfonic acid potassium salt, or the methacrylamidomethanesulfonic acid potassium salt.

8. The photographic element of claim 5 wherein the N-3-oxo-alyl substituted acrylamide monomer is N-3-oxo-1,1-dimethyl-butyl-acrylamide.

9. The photographic element of claim 6 wherein the acrylic ester monomer is butylacrylate, ethoxyethylacrylate, ethylhexylacrylate, hexylacrylate or ethylacrylate.

10. The photographic element of claim 3 wherein the inert monomers are chosen in the group consisting of ethylenic monomers, styrene type monomers, alkenoic acid esters, acylamides and vinylacetate.

11. The photographic element of claim 3 wherein the cross-linking monomer is a monomer having at least two independently polymerizable vinyl groups.

12. The photographic element of claim 11 wherein the cross-linking monomer has the formula:

$$CH_2{=}CH{-}R_8{-}CH{=}CH_2$$

wherein $R_8$ represents a divalent organic group.

13. The photographic element of claim 12 wherein $R_8$ represents a divalent organic group chosen in the group consisting of $-SO_2-CH_2-O-CH_2-O-CH_2-SO_2-$, $-SO_2-CH_2-CHOH-CH_2$ $-CO-NH-CO-$, $-CO-NH-CH_2-NH-SO_2-$, $-SO_2-CH_2-CH_2-SO_2-$and

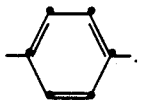

14. The photographic element of claim 1 wherein the polymer particles have an average diameter comprised in the range from 0.02 to 0.2 $\mu$.

15. A silver halide color photographic element comprising a support base and, coated thereon, at least a red sensitive silver halide emulsion layer comprising a dispersed hydrophobic non-diffusible cyan image dye forming non-diffusible coupler, at least a green sensitive silver halide emulsion layer comprising a dispered hydrophobic non-diffusible magenta image dye forming non-diffusible coupler and at least a blue sensitive silver halide emulsion layer comprising a dispersed hydrophobic non-diffusible yellow image dye forming non-diffusible coupler, wherein at least one silver halide emulsion layer comprises droplets of a high temperature boiling point organic solvent dispersed in said emulsion, said droplets containing dissolved therein a non-diffusible image dye forming non-diffusible coupler, and further polymer particles in a sufficient quantity to obtain controlled smearing of the image dye.

16. The light sensitive element of claim 15 wherein at least one silver halide emulsion layer is composed of a plurality of sub-layers having different sensitivities.

17. A method of forming a color image comprising (a) imagewise exposing a color silver halide photographic element comprising a support base and coated thereon a silver halide emulsion layer containing a dispersed hydrophobic non-diffusible coupler which, upon reaction with an oxidized color developing agent, forms a non-diffusible image dye and (b) developing in an aqueous alkaline solution comprising an aromatic primary amine developing agent said exposed silver halide photographic element, characterized by the fact that said developing is made in the presence of said coupler-containing hydrophobic droplets of a high temperature boiling point organic solvent dispersed in said emulsion layer in reactive association with hydrophobic polymer particles in a quantity sufficient to obtain a controlled smearing of the image dye.

18. A color silver halide photographic element comprising a support base and at least one silver halide emulsion layer containing dispersed therein a hydrophobic non-diffusible coupler which, upon reaction with an oxidized color developing agent, forms a non-diffusible image dye, characterized by the fact that said emulsion contains dispersed therein oil droplets, said oil droplets containing dissolved therein said non-diffusible coupler, and said emulsion further contains polymer particles in a sufficient quantity to obtain controlled smearing of the image dye.

19. The photographic element of claim 1 in which said droplets and said particles are in reactive association with each other.

20. The photographic element of claim 17 in which said droplets and said particles are in reactive association with each other.

* * * * *